US009289775B2

(12) United States Patent
Mepham et al.

(10) Patent No.: US 9,289,775 B2
(45) Date of Patent: Mar. 22, 2016

(54) DISCHARGE GRATE ASSEMBLY

(71) Applicant: Polycorp Ltd., Elora (CA)

(72) Inventors: Robert Mepham, Fergus (CA); David J. Page, Elora (CA); Pramod Kumar, Waterloo (CA)

(73) Assignee: Polycorp Ltd., Elora, Ontario (CA)

( * ) Notice: Subject to any disclaimer, the term of this patent is extended or adjusted under 35 U.S.C. 154(b) by 93 days.

(21) Appl. No.: 14/083,585

(22) Filed: Nov. 19, 2013

(65) Prior Publication Data

US 2014/0138466 A1 May 22, 2014

Related U.S. Application Data

(60) Provisional application No. 61/729,370, filed on Nov. 22, 2012.

(51) Int. Cl.
*B02C 17/18* (2006.01)

(52) U.S. Cl.
CPC ..... *B02C 17/1855* (2013.01); *B02C 17/1835* (2013.01); *B02C 17/183* (2013.01)

(58) Field of Classification Search
CPC ..... B02C 17/1855; B02C 17/1835; B02C 17/183
USPC ..... 241/70, 71, 299, 21
See application file for complete search history.

(56) References Cited

U.S. PATENT DOCUMENTS 2,950,869 A * 8/1960 Wales ..... 241/70
3,231,203 A 1/1966 Russel et al.
3,739,993 A 6/1973 Nelson et al.
3,785,577 A 1/1974 Carlsmith et al.
3,806,045 A 4/1974 Jenness
3,987,970 A 10/1976 Burkett
4,049,206 A 9/1977 König et al.
4,089,476 A * 5/1978 Gauer ..... 241/70
4,312,749 A 1/1982 Bingham
4,365,763 A 12/1982 Guerguerian
4,441,659 A 4/1984 Marklund
4,533,054 A 8/1985 Sommer, Jr. et al.
4,542,856 A 9/1985 Adolph
4,646,980 A 3/1987 Player et al.
4,836,457 A 6/1989 Greiner
4,982,904 A 1/1991 Greiner
5,361,997 A 11/1994 Burkes (Continued)

FOREIGN PATENT DOCUMENTS

WO WO9801226 1/1998
WO PCT/CA2009/001085 6/2011

*Primary Examiner* — Faye Francis

(57) ABSTRACT

A discharge grate assembly for at least partially guiding slurry from a mill shell chamber toward a discharge trunnion thereof via a pulp lifter chamber. The discharge grate assembly includes a body having apertures for permitting the slurry to flow from the mill shell chamber into the pulp lifter chamber, and a shroud having a number of cover elements and a number of openings located at least partially therebetween. The shroud is movable relative to the body between an open position, in which the openings are at least partially aligned with at least preselected ones of the apertures to permit the slurry to flow therethrough into the pulp lifter chamber, and a closed position, in which the cover elements are at least partially aligned with at least predetermined ones of the apertures, to at least partially prevent the slurry flowing through the apertures back into the mill shell chamber.

5 Claims, 9 Drawing Sheets

(56) References Cited

U.S. PATENT DOCUMENTS

| | | | | |
|---|---|---|---|---|
| 5,381,971 | A | 1/1995 | Rehmer | |
| 5,598,981 | A | 2/1997 | Hellmich | |
| 5,722,607 | A | 3/1998 | Hellmich | |
| 6,663,030 | B2 | 12/2003 | Washburn et al. | |
| 7,204,636 | B2 | 4/2007 | Didion | |
| 8,109,457 | B2 * | 2/2012 | Latchireddi | 241/70 |
| 8,308,906 | B2 | 11/2012 | Page et al. | |
| 2005/0152217 | A1 | 7/2005 | O'Hara | |
| 2006/0283993 | A1 | 12/2006 | Latchireddi | |

* cited by examiner

DISCHARGE GRATE ASSEMBLY

This application claims the benefit of U.S. Provisional Application No. 61/729,370, filed on Nov. 22, 2012, and incorporates such provisional application in its entirety by reference.

BACKGROUND OF THE INVENTION

In a grinding mill, slurry flows from a mill shell chamber into pulp lifter chambers due to charge pressure and gravity as a mill shell thereof rotates about its axis of rotation. Slurry is directed out of the mill (typically, via a central opening to a discharge trunnion) by pulp lifters or similar elements which define the pulp lifter chambers therebetween. As is well known in the art, each pulp lifter chamber is also partially defined by a mill grate, or discharge grate.

The pulp lifters typically are mounted on a discharge end wall (or mill head) of the mill. Often, the end wall is positioned at an angle (e.g., 75°) relative to a center line of the central opening in the end wall, i.e., the end wall forms a truncated cone. However, substantially vertical end walls are also common. As is known, a charge typically is positioned in a lower part of the mill shell chamber, filling the mill shell chamber to a limited extent.

As is also known, the slurry flows into the pulp lifter chambers via apertures in the mill grate as the mill shell rotates. (For the purposes of discussion herein, rotation is assumed to be counter-clockwise, i.e., the discharge end, as viewed from inside the mill shell chamber, is assumed to rotate counter-clockwise. However, as is well known in the art, rotation may be clockwise or counter-clockwise.) In practice, slurry flows through the discharge grate and into a particular pulp lifter chamber under the influence of charge pressure and gravity when that pulp lifter chamber is between about the 8 o'clock and the 4 o'clock positions. As the mill shell rotates in a counter-clockwise direction, the particular pulp lifter chamber is raised from the 4 o'clock position upwardly to the 12 o'clock position, after which the pulp lifter chamber moves downwardly. As the pulp lifter chamber is so raised, and also as the pulp lifter chamber begins to be lowered (i.e., after it has passed the 12 o'clock position), slurry flows from the pulp lifter chamber to the discharge trunnion. However, in the prior art, "back flow" of the slurry, i.e., from the pulp lifter chamber back into the mill shell chamber, may occur.

Typically, the mill is rotated at a relatively high speed, to achieve optimal throughput. For example, a typical mill with an internal diameter of about 32 feet (approximately 9.8 meters) may rotate at about 10 revolutions per minute. Any decrease in rotation speed is generally thought to be counter-productive, as any such decrease would be likely to decrease throughput.

In the prior art, attempts to increase production (i.e., mill throughput) have focused on increasing the sizes and/or the numbers of the apertures in the mill grates (or discharge grates). The idea is that a grate having larger apertures, and/or more apertures, should result in a larger volume of slurry flowing through the grate, and therefore into the pulp lifter chamber from the mill shell chamber, in the relatively short time period when the grate is at least partially submerged in the charge.

However, this incorrectly assumes that all the slurry in the pulp lifter chamber is moved out of the mill via the discharge trunnion in the prior art. As noted above, in practice, a portion of the slurry typically flows back into the mill shell chamber via the apertures in the mill grate as the mill shell rotates, when the pulp lifter chamber is positioned above the charge. Depending on the circumstances, the back flow may be relatively large. Typically, back flow of the slurry from a particular pulp lifter chamber occurs when that chamber is between about the 3 o'clock position and about the 9 o'clock position. Back flow generally is a more significant problem in mills with inclined discharge end walls.

It is clear that back flow has a negative impact on mill productivity, and it is also clear that back flow may have a very significant negative impact (especially where the discharge end wall is inclined), depending on its volume. In any event, back flow clearly undermines attempts to increase mill productivity which are sought to be achieved solely by increasing the sizes and/or the numbers of the apertures in mill grates.

SUMMARY OF THE INVENTION

For the foregoing reasons, there is a need for a discharge grate assembly that overcomes or mitigates one or more of the disadvantages of the prior art.

In its broad aspect, a discharge grate assembly for at least partially guiding slurry from a mill shell chamber in a rotating mill shell toward a discharge trunnion thereof via a pulp lifter chamber. The discharge grate assembly includes a body having a number of apertures for permitting the slurry to flow from the mill shell chamber into the pulp lifter chamber, and a shroud with a number of cover elements and a number of openings located at least partially between the cover elements. The shroud is movable relative to the body between an open position, in which the openings are at least partially aligned with at least preselected ones of the apertures to permit the slurry to flow therethrough into the pulp lifter chamber, and a closed position, in which the cover elements are at least partially aligned with at least predetermined ones of the apertures, to at least partially prevent the slurry flowing through the apertures back into the mill shell chamber.

In another aspect, the invention provides a grinding mill including a shell rotatable in a predetermined direction about a central axis thereof to produce a slurry including liquid and particles from a charge in the shell. The grinding mill also includes a discharge end wall attached to the shell, the discharge end wall extending between an outer edge thereof connected to the shell and an inner edge at least partially defining a central opening in the discharge end wall, and a plurality of pulp lifter chambers at least partially defined by the discharge end wall. The grinding mill additionally includes a number of discharge grate assemblies positioned to at least partially control flow of slurry into each pulp lifter chamber respectively. Each discharge grate assembly is rotatable in the predetermined direction between a lowered condition, in which the slurry is flowable through at least part of the discharge grate assembly, and a raised condition, in which the discharge grate assembly is positioned above the charge. Each discharge grate assembly additionally has a shroud comprising a number of cover elements and a number of openings between the cover elements, the shroud being movable relative to the body between an open position, in which the openings are at least partially aligned with at least preselected ones of the apertures to permit the slurry to flow therethrough into the pulp lifter chamber, and a closed position in which the cover elements are at least partially aligned with at least predetermined ones of the apertures, to at least partially prevent the slurry flowing through the apertures.

BRIEF DESCRIPTION OF THE DRAWINGS

The invention will be better understood with reference to the attached drawings, in which.

DETAILED DESCRIPTION

Figure 1:
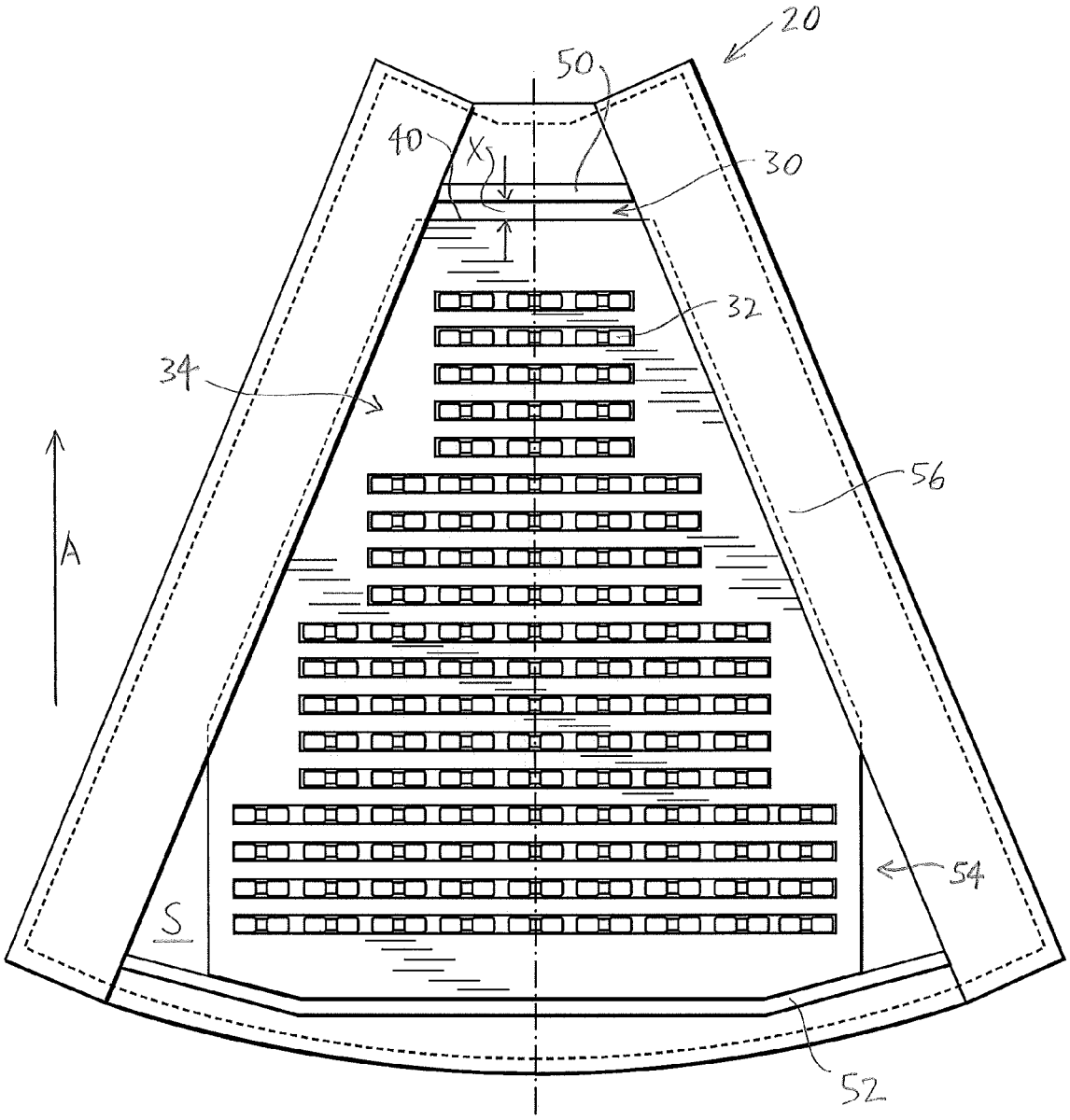
FIG. 1 is a top view of an embodiment of a discharge grate assembly of the invention in which a shroud thereof is in an open position relative to a body thereof.
Figure 2:
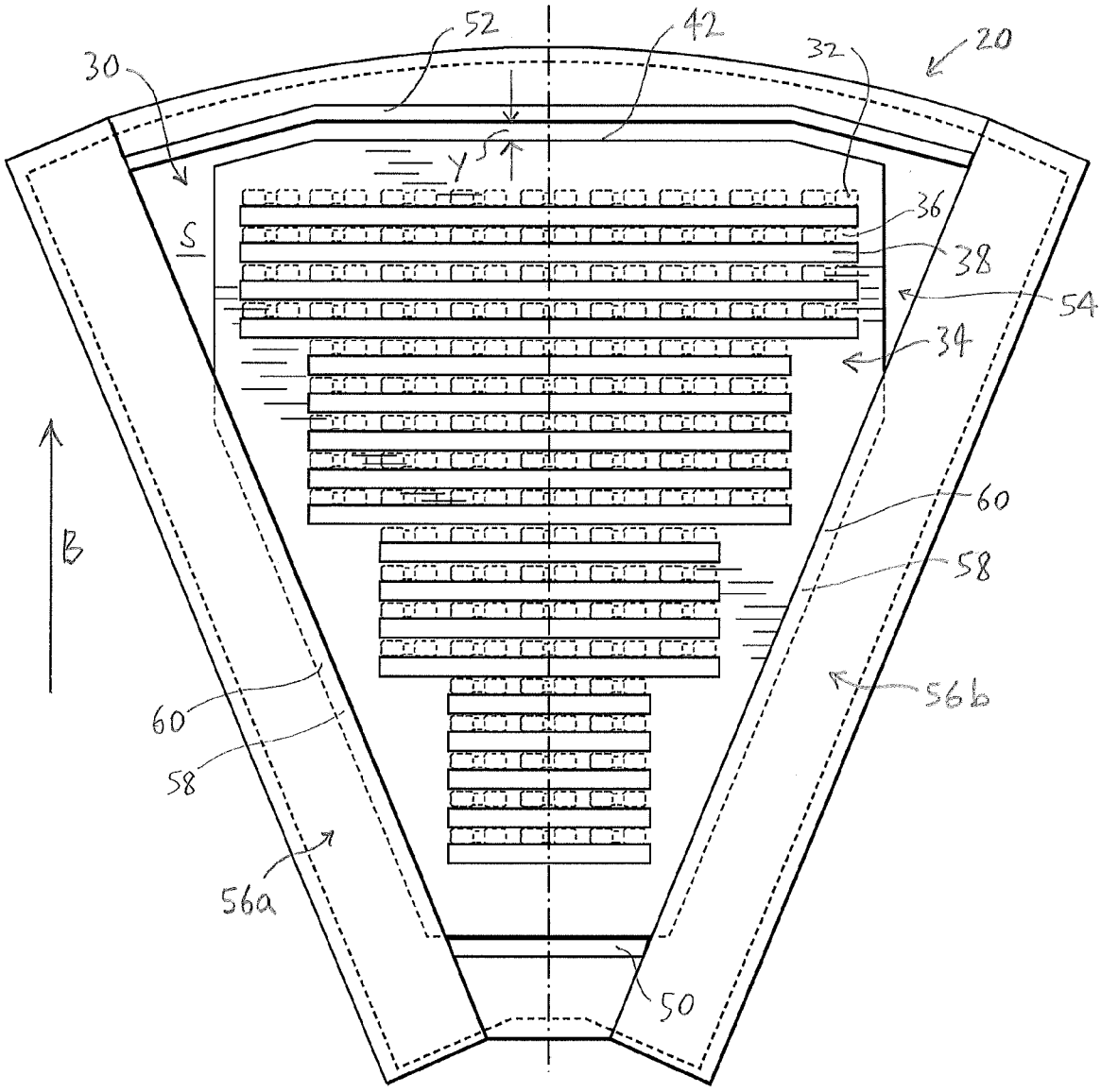
FIG. 2 is a top view of the discharge grate assembly of FIG. 1 in which the shroud is in a closed position relative to the body.
Figure 3:
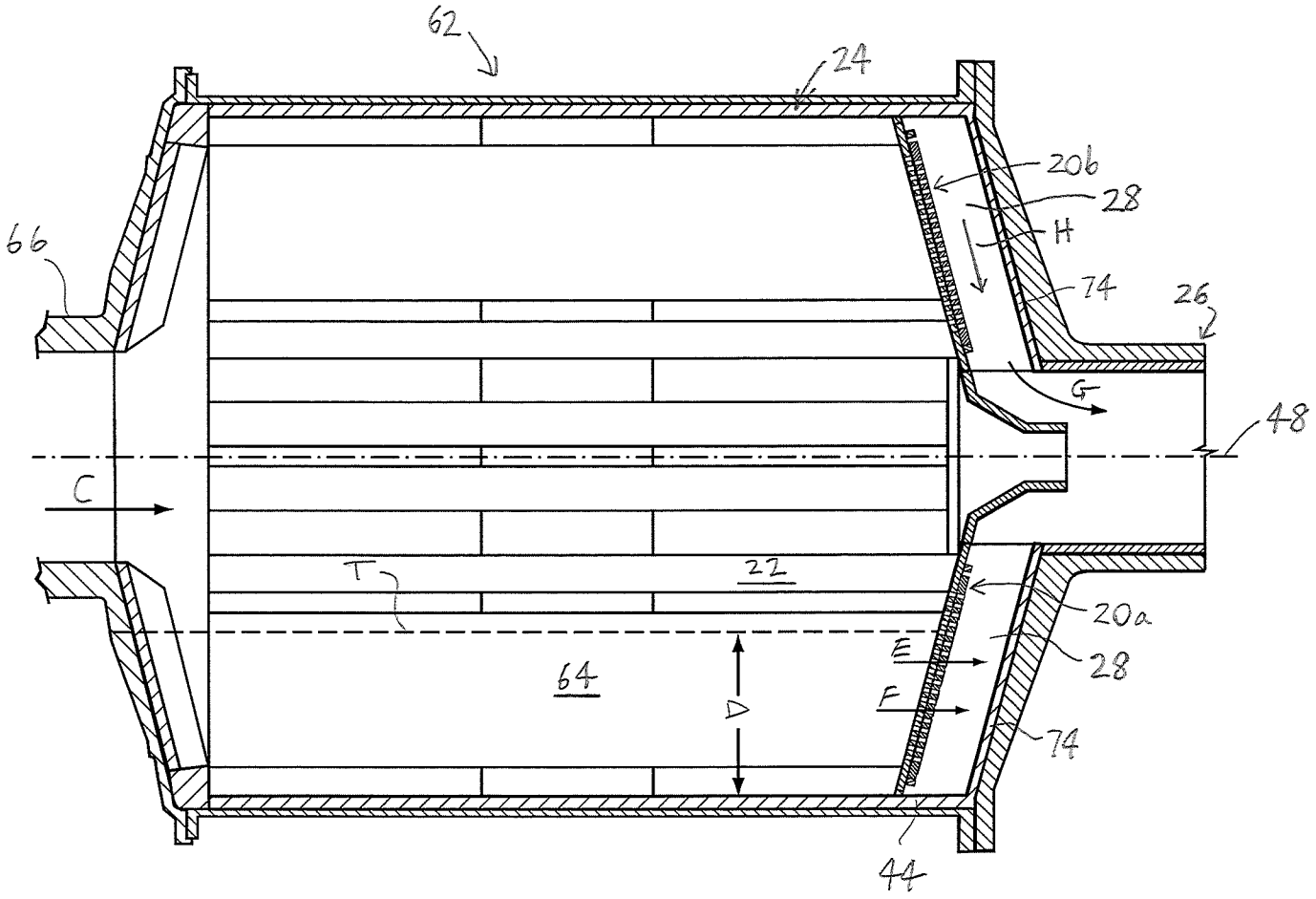
FIG. 3 is a cross-section of an embodiment of a grinding mill of the invention that includes a number of the discharge grate assemblies of FIGS. 1 and 2, drawn at a smaller scale.
Figure 4:
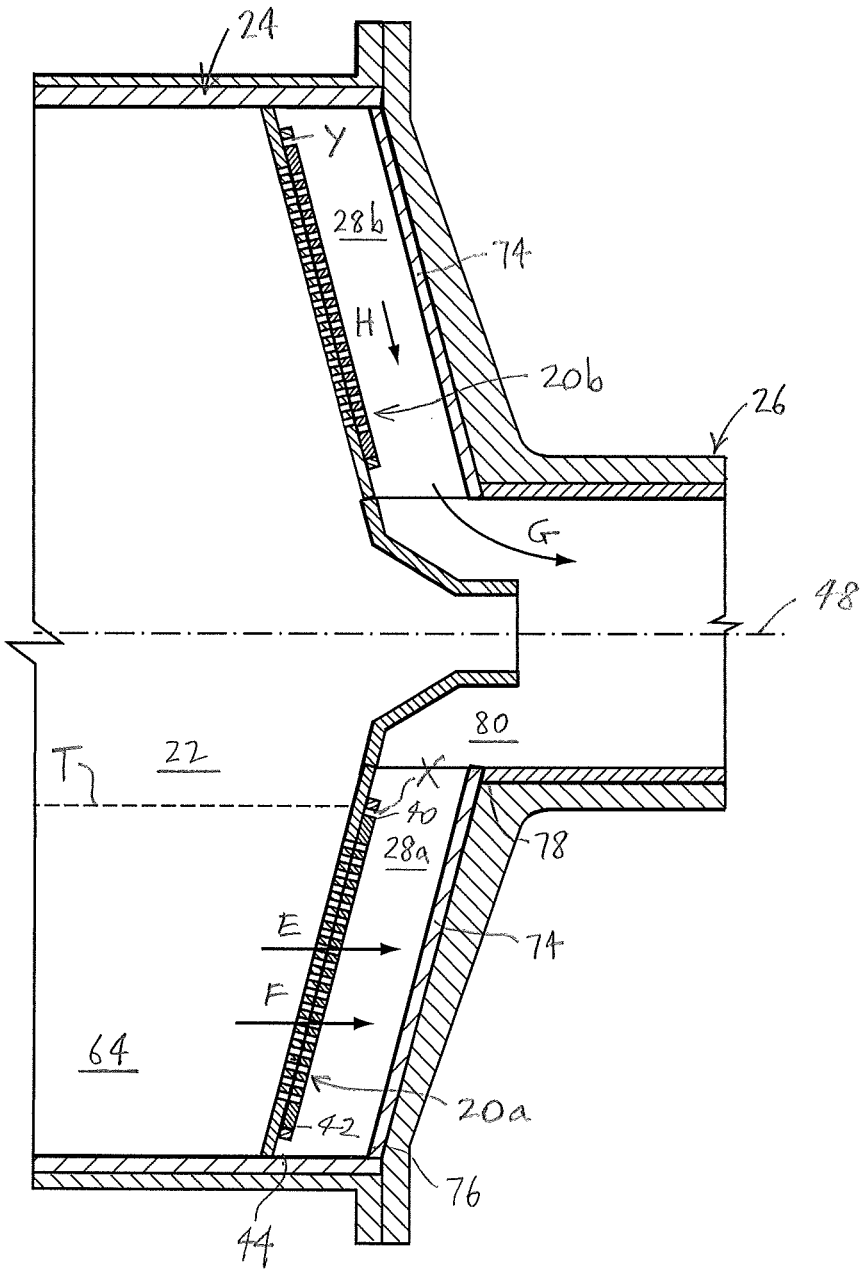
FIG. 4 is a cross-section of a portion of the grinding mill of FIG. 3, drawn at a larger scale.

In the attached drawings, like reference numerals designate corresponding elements throughout. Reference is first made to FIGS. 1-5 to describe an embodiment of a discharge assembly of the invention referred to generally by the numeral 20. As can be seen in FIG. 3, the discharge grate assembly 20 is for at least partially guiding slurry from a mill shell chamber 22 in a rotatable mill shell 24 toward a discharge trunnion 26 thereof via a pulp lifter chamber 28. In one embodiment, the discharge grate assembly 20 preferably includes a body 30 having a number of apertures 32 (FIGS. 1, 2) for permitting the slurry to flow from the mill shell chamber 22 into the pulp lifter chamber 28 (FIGS. 3, 4). It is also preferred that the discharge grate assembly 20 includes a shroud 34 having a number of cover elements 36 and a number of openings 38 located at least partially between the cover elements 36 (FIGS. 1, 2). Preferably, the shroud 34 is movable relative to the body 30 between an open position (FIG. 1), in which the openings 38 are at least partially aligned with at least preselected ones of the apertures 32 to permit the slurry to flow therethrough into the pulp lifter chamber 28, and a closed position (FIG. 2), in which the cover elements 36 are at least partially aligned with at least predetermined ones of the apertures 32, to at least partially prevent the slurry flowing through the apertures 32 back into the mill shell chamber.

One embodiment of the discharge grate assembly 20 is shown in FIGS. 1 and 2. In FIG. 1, the shroud 34 is shown in the open position, and in FIG. 2, the shroud 34 is shown in the closed position. As can be seen in FIGS. 1 and 2, the shroud 34 preferably extends between an inner end 40 (FIG. 1) and an outer end 42 (FIG. 2). As can be seen in FIGS. 3 and 4, when the discharge grate assembly 20 is mounted in the mill shell 24, the outer end 42 is proximal to a side portion 44 of the mill shell 24, and the inner end 40 is positioned between the side portion 44 and an axis of rotation 48 about which the mill shell 24 rotates.

In one embodiment, the body 30 includes inner and outer stop elements 50, 52. As can be seen in FIG. 1, when the shroud 34 is in the open position, the outer end 42 of the shroud 34 is engaged with the outer stop element 52, which locates the shroud 34 in the open position. Similarly, when the shroud 34 is in the closed position (in FIG. 2), the inner end 40 of the shroud 34 is engaged with the inner stop element 50, which locates the shroud 34 in the closed position.

The inner end 40 and the inner stop element 50 can best be seen in FIG. 1, and the outer end 42 and the outer stop element 52 can best be seen in FIG. 2.

When the shroud 34 is in the open position, it is movable to the closed position (i.e., movable in the direction indicated by arrow "A" in FIG. 1), as described above. Similarly, when the shroud 34 is in the closed position, it is movable to the open position (i.e., movable in the direction indicated by arrow "B" in FIG. 2), as is also described above.

As can be seen in FIGS. 1 and 2, in one embodiment, the body 30 preferably includes a main portion 54 and one or more retainer portions 56. The apertures 32 are located in the main portion 54. It is preferred that the main portion 54 is, on at least one side "S" thereof, substantially planar. As illustrated, the body 30 preferably includes two retainer portions that are identified in FIG. 2, for clarity of illustration, as 56*a* and 56*b*. Preferably, the retainer portions 56*a*, 56*b* are at least partially spaced apart from the main portion 54 to define a space 58 therebetween in which edge portions 60 of the shroud 34 are slidably receivable. In this way, the shroud 34 is held relatively closely to the main portion 54 because of the edge portion 60 held between the retainer portions 56 and the main portion 54, but permitted to move relative to the body 30. From the foregoing, it can be seen that the shroud 34 is generally in sliding engagement with the surface "S" of the main portion 54, when the shroud 34 moves between the open and closed positions.

In use, when the discharge grate assembly 20 is in a position where the slurry is to be permitted to flow therethrough, the shroud 34 is in the open position relative to the body 30 (FIG. 1). When the shroud 34 is in the open position, the outer end 42 engages the outer stop element 52, because the shroud 34 is located in the open position. As can be seen in FIG. 1, when the shroud 34 is in the open position, the inner end 40 is spaced apart from the inner stop element 50 to define a first gap "X" therebetween.

Also, when the discharge grate assembly 20 is in the closed position, the shroud 34 substantially prevents the slurry from flowing through the apertures 32. The shroud 34 is located in the closed position due to the engagement of the inner end 40 with the inner stop element 50 (FIG. 2). As can be seen in FIG. 2, the inner end 40 engages the inner stop element 50, when the shroud 34 is in the closed position. Also, when the shroud 34 is in the closed position, the outer end 42 is spaced apart from the outer stop element 52 to define a second gap "Y" therebetween.

A cross-section of an embodiment of a grinding mill 62 of the invention including a number of the discharge grate assemblies 20 is illustrated in FIG. 3. It will be understood that the discharge grate assemblies 20 are radially positioned around the axis of rotation. As can be seen in FIG. 3, a charge 64 preferably is positioned in the mill shell chamber 22 in the mill shell 24, the charge 64 having a depth "D". The charge 64 is introduced into the mill shell chamber 22 at an intake end 66 of the mill shell 24, as indicated by arrow "C". As is known, the depth "D" of the charge 64 preferably is such that a top surface "T" of the charge is below the axis of rotation.

For clarity of illustration, the discharge grate assemblies shown in FIGS. 3 and 4 are identified as 20*a* and 20*b*. In addition, and also for the purposes of illustration, the discharge grate assemblies 20*a* and 20*b* are shown in FIGS. 3 and 4 in the 6 o'clock and 12 o'clock positions respectively.

Those skilled in the art would appreciate that there are a number of other discharge grate assemblies positioned between the discharge grate assemblies 20*a*, 20*b*, and such other discharge grate assemblies are omitted from FIGS. 3 and 4 for clarity of illustration. Those skilled in the art would also appreciate that, as the mill shell 24 rotates about the axis 48 in a predetermined direction, the discharge grate assemblies 20 are also moved around the axis of rotation in turn. Each of the discharge grate assemblies 20 is respectively rotatable between a lowered condition, in which the slurry is potentially flowable through at least part of the discharge grate assembly, and a raised condition, in which the discharge grate assembly is located above the charge.

For convenience, in FIG. 4, the pulp lifter chambers are shown in the 6 o'clock and 12 o'clock positions and are identified as 28*a* and 28*b* respectively. As indicated by arrows "E" and "F" in FIGS. 3 and 4, because the shroud 34 of the discharge grate assembly 20*a* is in the open position, the slurry moves through the apertures 32 and the openings 38 of the discharge grate assembly 20*a* into the pulp lifter chamber 28*a*. Similarly, in the discharge grate assembly 20*b* positioned at the 12 o'clock position, the shroud 34 is in the closed position. Accordingly, the slurry exits the pulp lifter chamber 28*b* toward the discharge trunnion 26, as schematically indicated by arrows "G" and "H" in FIGS. 3 and 4. As can be seen in FIGS. 3 and 4, because the discharge grate assembly 20*b* is closed, backflow is substantially prevented thereby.

Those skilled in the art would be aware that the shroud 34 preferably is in the open position when the discharge grate assembly 20 is in the lowered condition. Also, the shroud 34 preferably is in the closed position when the discharge grate assembly 20 is in the raised condition.

Figure 5:
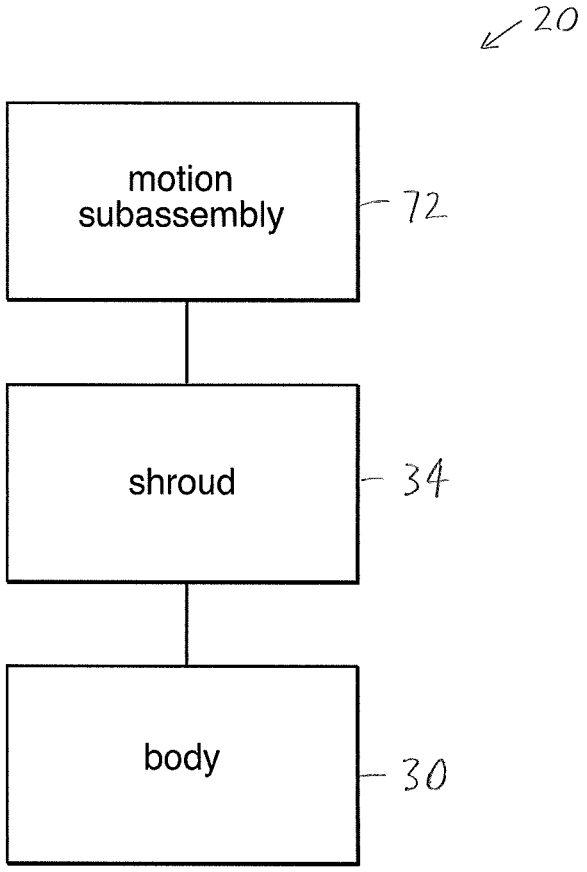
FIG. 5 is a block diagram schematically representing an embodiment of a discharge grate assembly of the invention.

In one embodiment, the discharge grate assembly 20 preferably also includes one or more motion subassemblies 72, for moving the shroud between the closed and open positions. The discharge grate assembly 20 with the motion subassembly 72 is schematically illustrated in FIG. 5. It will be understood that the motion subassembly 72 preferably moves the shroud 34 between the open and closed positions as the mill shell 24 rotates, with the shroud 34 preferably being in the open position when the discharge grate apparatus 20 is in the lowered condition, and the shroud 34 preferably being in the closed position when the discharge grate assembly 20 is in the raised condition.

Preferably, the motion subassembly 72 is any suitable device that moves the shroud 34 between the closed and open positions therefor at the appropriate times, as the discharge grate assembly 20 is rotated about the axis of rotation 48. Such devices may include any suitable devices, for example, appropriately controlled electronic devices. It would also be appreciated by those in the art that a suitable device would be adapted to operate in the extreme conditions inside the rotating mill shell 24.

In one embodiment, the movement of the shroud 34 between the closed and open positions as the mill shell 24 rotates is at least partially due to gravity. However, those skilled in the art would appreciate that gravity alone may not be sufficient to move the shroud 34 between the closed and open positions, especially since it is believed that fines accumulating between the shroud 34 and the main portion 54 (and also in the space 58) would tend to impede movement of the shroud 34 relative to the body 30.

It is also preferred that in one embodiment, the grinding mill 62 of the invention includes the mill shell 24 rotatable in the predetermined direction about the central axis 48 thereof to produce the slurry including liquid and particles from the charge 64 in the shell 24. As shown in FIG. 4, the grinding mill 62 preferably includes a discharge end wall 74 attached to the shell 24, the discharge end wall 74 extending between an outer edge 76 thereof connected to the shell 24 and an inner edge 78 at least partially defining a central opening 80 in the discharge end wall 74. It is also preferred that the grinding mill 62 includes a number of pulp lifter chambers at least partially defined by the discharge end wall 74. The grinding mill 62 preferably also includes a number of the discharge grate assemblies 20 positioned to at least partially control flow of slurry into each said pulp lifter chamber respectively. Each discharge grate assembly is rotatable (i.e., as the mill shell rotates) in the predetermined direction between a lowered condition, in which the slurry is flowable through at least part of the discharge grate assembly, and a raised condition, in which the discharge grate assembly is positioned above the charge. It is also preferred that the discharge grate assembly 20 includes the shroud 34 with a number of cover elements 36 and a number of openings 38 between the cover elements 36. The shroud 34 is movable relative to the body 30 between an open position (FIG. 1), in which the openings are at least partially aligned with at least preselected ones of the apertures 32 to permit the slurry to flow therethrough into the pulp lifter chamber 28, and a closed position (FIG. 2), in which the cover elements 36 are at least partially aligned with at least predetermined ones of the apertures 32, to at least partially prevent the slurry flowing through the apertures 32.

Those skilled in the art would appreciate that the mill shell and, with it, the discharge grate assemblies (and other elements) are rotated around the central axis at a relatively high speed. Accordingly, the motion subassembly 72 (not shown in FIGS. 3 and 4) preferably is configured to move the shroud 34 relative to the body 30 relatively rapidly, and also at the appropriate times. For example, in any selected one of the discharge grate assemblies, the shroud 34 preferably is moved into the closed position just after the discharge grate assembly is rotated to the raised condition. Similarly, the shroud 34 preferably is moved to the open position just before the discharge grate assembly is moved to the lowered condition.

As can be seen in FIGS. 3 and 4, it is preferred that the movement of the shroud 34 between the open and closed positions is substantially in radial directions relative to the central axis 48. In FIG. 4, arrow "E" indicates the direction of movement of the shroud 34 relative to the body 30 of the discharge grate assembly 20*a*, when the shroud 34 is moving from the closed position to the open position. Arrow "F" indicates the direction of movement of the shroud 34 relative to the body 30 of the discharge grate assembly 20*b*, when the shroud 34 is moving from the open position to the closed position.

From the foregoing, it can be seen that the discharge grate assembly 20 is configured to permit the slurry to flow through it (i.e., when the discharge grate assembly 20 is in the lowered condition), and to at least partially prevent the slurry from flowing through the apertures back into the mill shell chamber (i.e., when the discharge grate assembly is in the raised condition). It will be understood that the discharge grate assembly 20 can be created with appropriate modification of a pre-existing discharge grate, i.e., the invention herein includes retrofit arrangements in which a shroud of the invention is positioned proximal to a pre-existing body. Those skilled in the art would also appreciate that, where it is desired to create a discharge grate assembly of the invention using a pre-existing body, the openings and the cover elements in the shroud preferably are formed to align with the apertures in the body, i.e., when the shroud is in the open and closed positions respectively. It will also be understood that a number of other modifications may be made to the body to implement the invention, e.g., stop elements and retainer portions of the invention may be added to the body. Those skilled in the art would appreciate that other modifications may be made to the pre-existing body, e.g., parts of the pre-existing body may be removed in order to permit the full extent of movement of the shroud relative to the body. Also, the motion subassembly of the invention preferably is mounted to the modified body. It will be understood that the invention herein includes the elements used to implement the invention by retrofitting the pre-existing discharge grate body.

Figure 6:
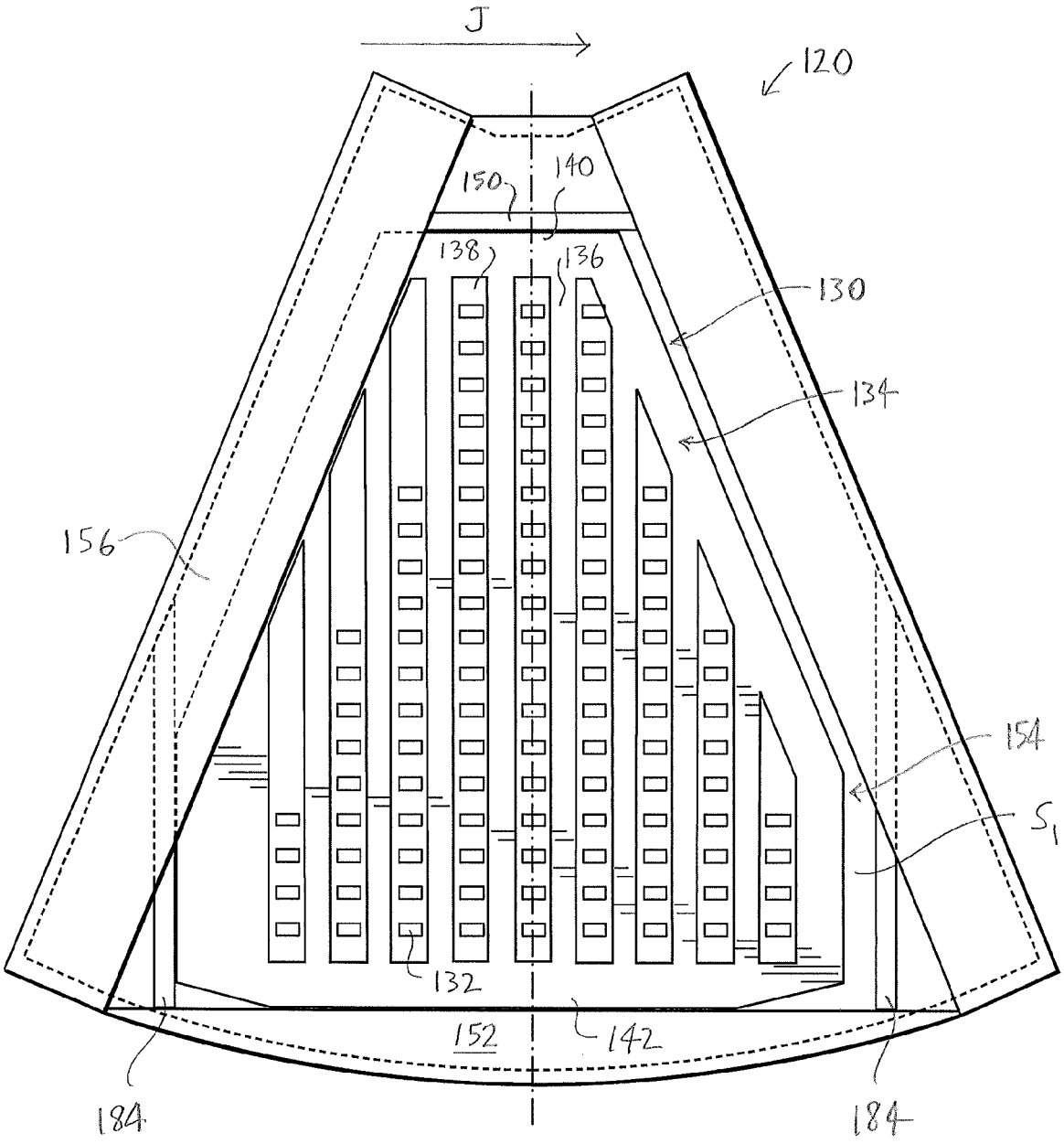
FIG. 6 is a top view of an alternative embodiment of a discharge grate assembly of the invention in which a shroud thereof is in an open position relative to a body thereof, drawn at a larger scale.
Figure 7:
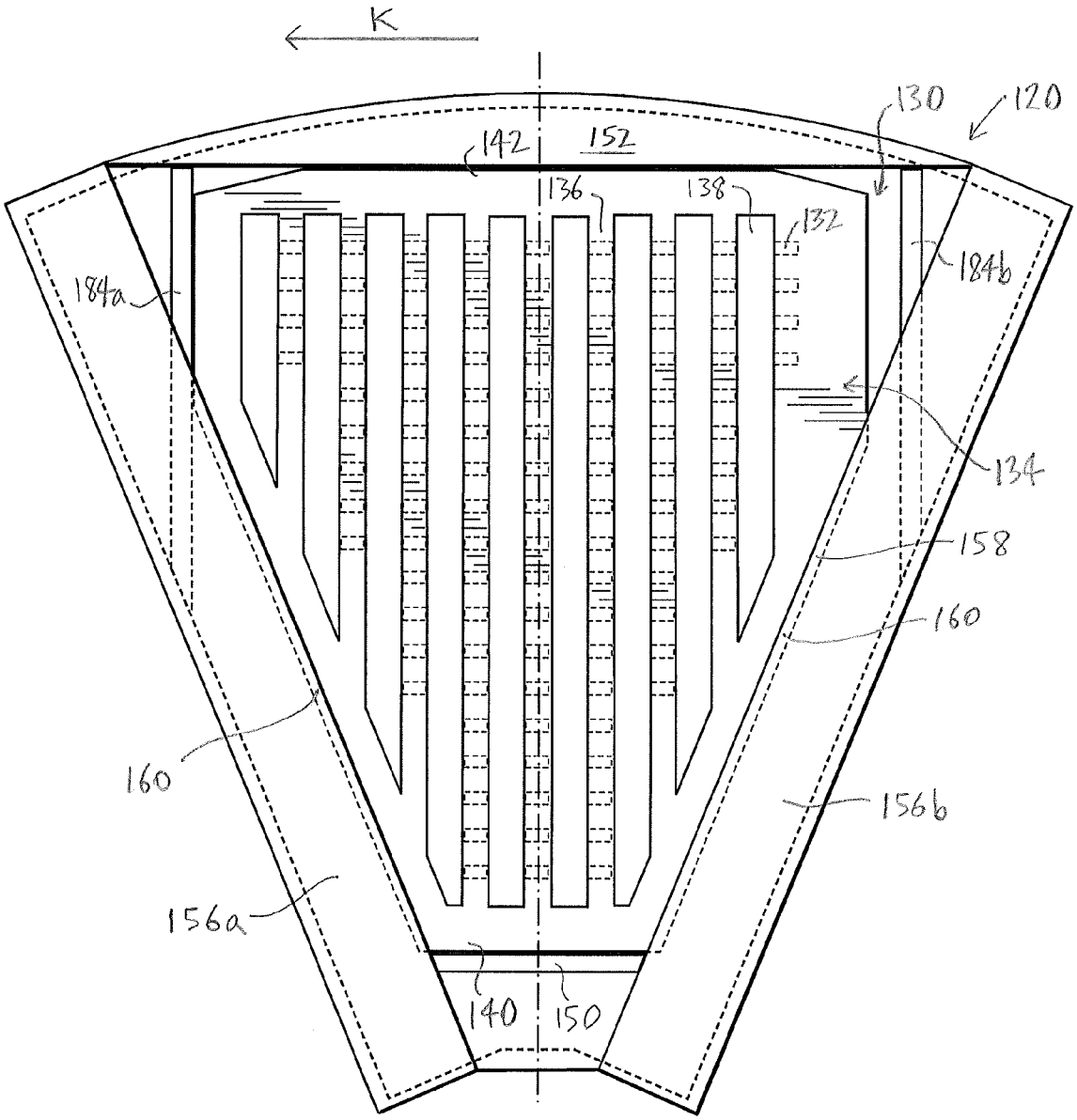
FIG. 7 is a top view of the discharge grate assembly of FIG. 6 in which the shroud is in a closed position relative to the body.
Figure 8:
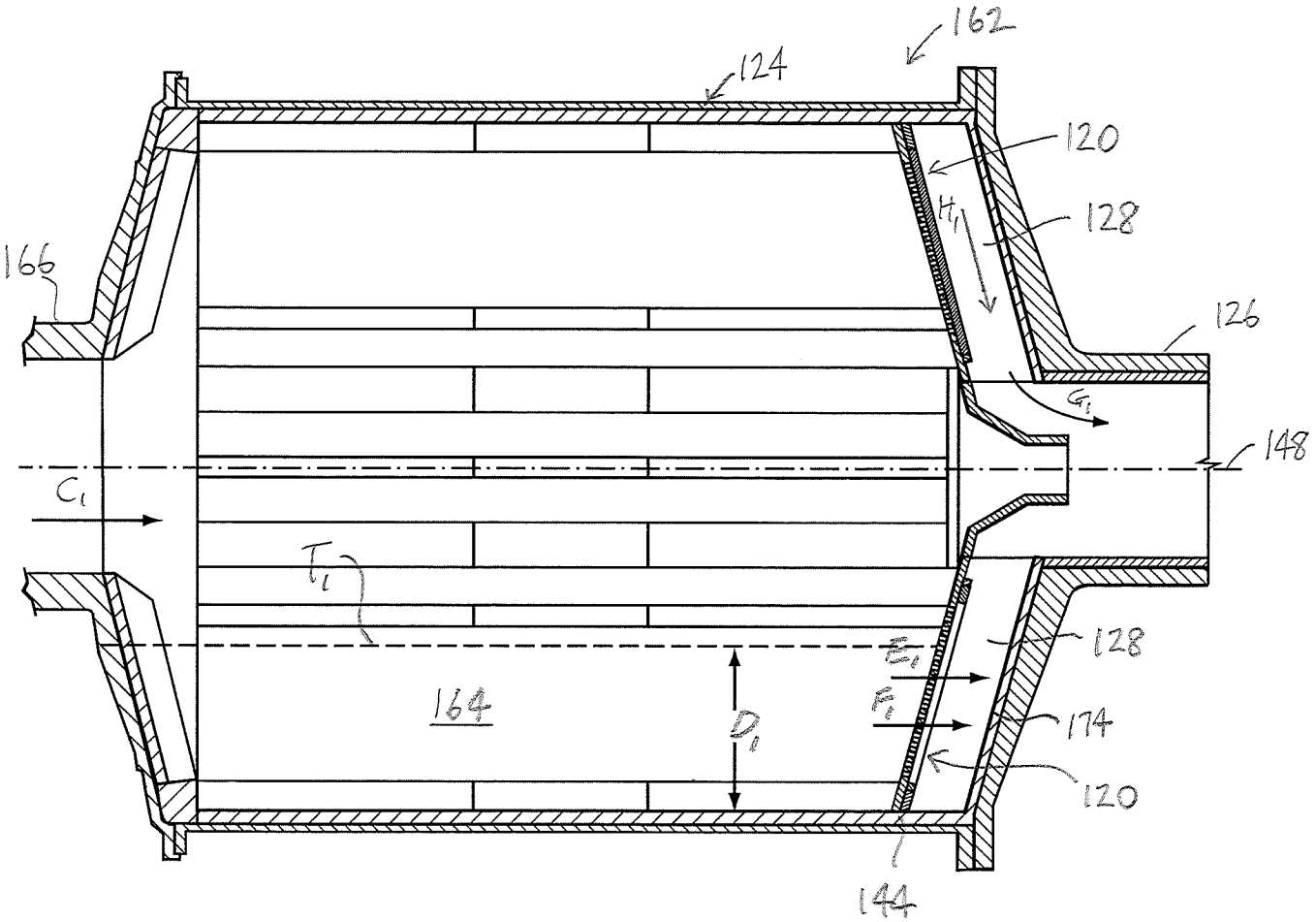
FIG. 8 is a cross-section of an embodiment of a grinding mill of the invention that includes a number of the discharge grate assemblies of FIGS. 6 and 7, drawn at a smaller scale.
Figure 9:
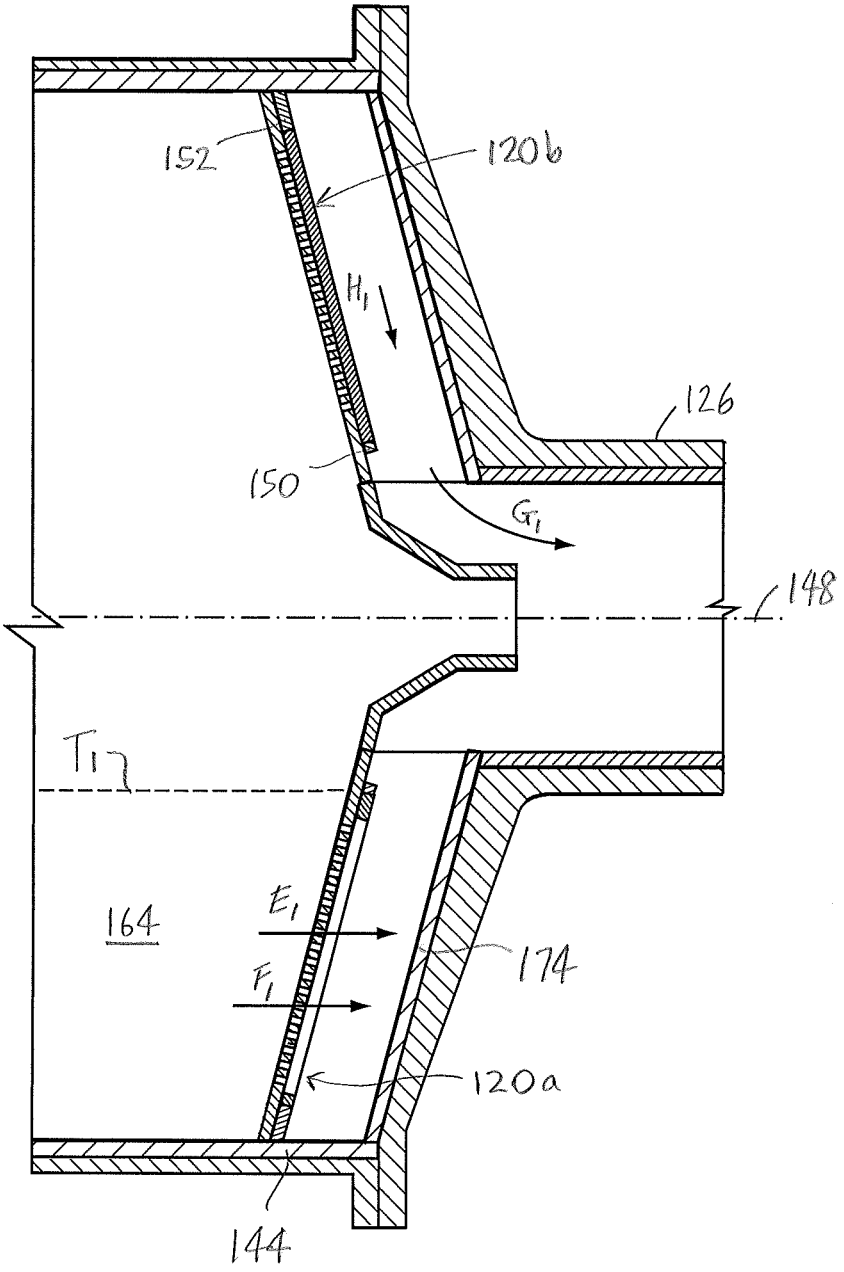
FIG. 9 is a cross-section of a portion of the grinding mill of FIG. 8, drawn at a larger scale.

An alternative embodiment of a discharge grate assembly 120 of the invention is illustrated in FIGS. 6 and 7. Also, an alternative embodiment of a grinding mill 162 of the invention, including the discharge grate assemblies 120, is illustrated in FIGS. 8 and 9.

In one embodiment, the discharge grate assembly 120 includes a body 130 with apertures 132 formed therein, and a shroud 134 including a number of cover elements 136 with a number of openings 138 at least partially between the cover elements 136. As can be seen in FIGS. 6 and 7, in one embodiment, the shroud 134 preferably is movable between an open position (FIG. 6), in which the openings 138 are at least partially aligned with the apertures 132 to permit slurry to flow therethrough, and a closed position (FIG. 7), in which the cover elements 136 are at least partially aligned with at least a predetermined number of the apertures 132, to at least partially prevent the slurry flowing through the apertures 132.

From the foregoing, it can be seen that when the shroud 134 is in the open position, it is movable to the closed position (i.e., movable in the direction indicated by arrow "J" in FIG. 6). When the shroud is in the closed position (FIG. 7), it is movable to the open position (i.e., movable in the direction indicated by arrow "K" in FIG. 7).

As can be seen in FIGS. 6 and 7, the shroud 134 is movable between the open and closed positions in a direction that is substantially orthogonal to a radial direction relative to the central axis.

Those skilled in the art would be aware that the shroud 134 is movable, as indicated above, in generally sideways directions, relative to an axis of rotation 148 of a mill shell 124. Such motion may be achieved by use of a motion subassembly, as described above.

As can be seen in FIGS. 8 and 9, in one embodiment, the grinding mill 162 of the invention preferably includes the mill shell 124 rotatable in a predetermined direction about the axis 148 thereof to produce the slurry including liquid and particles from a charge 164 in a mill shell chamber 122 in the shell 124. Preferably, the grinding mill 162 also includes a number of pulp lifter chambers 128 at least partially defined by a discharge end wall 174 attached to the mill shell 124. It is also preferred that the grinding mill 162 includes a number of the discharge grate assemblies 120 positioned to at least partially control flow of slurry into the pulp lifter chambers 128 respectively. Each discharge grate assembly 120 is rotatable (i.e., with the mill shell 124) in the predetermined direction between a lowered condition, in which the slurry is flowable through at least part of the discharge grate assembly 120, and a raised condition, in which the discharge grate assembly 120 is positioned above the charge.

As can be seen in FIGS. 6 and 7, the shroud 134 preferably extends between inner and outer ends 140, 142. As shown in FIGS. 8 and 9, when the discharge grate assembly 120 is mounted in the mill shell 124, the outer end 142 is proximal to a side portion 144 of the mill shell 124, and the inner end 140 is positioned between the side portion 144 and the axis of rotation 148 about which the mill shell 124 rotates.

As can be seen in FIGS. 6 and 7, the body 130 preferably is positioned between inner and outer stop elements 150, 152. The inner end 140 is slidably engaged with the inner stop element 150, and the outer end 142 is slidably engaged with the outer stop element 152.

In one embodiment, the body 130 preferably includes a main portion 154 and one or more retainer portions 156. The apertures 132 are located in the main portion 154. Preferably, the main portion is, on at least one side "$S_1$" thereof, substantially planar, so that the shroud can move over the surface "$S_1$" relatively easily. As illustrated, the body 130 preferably includes two retainer portions that are identified in FIG. 7, for clarity of illustration, as 156*a* and 156*b*. It is preferred that the retainer portions 156*a*, 156*b* are at least partially spaced apart from the main portion 154 to define a space 158 therebetween in which edge portions 160 of the shroud are slidably receivable. It will be understood that the shroud 134 is generally in sliding engagement with the surface "$S_1$" of the main portion 154, when the shroud 134 moves between the open and closed positions.

As shown in FIGS. 6 and 7, the discharge grate assembly 120 preferably also includes side elements 184, for stopping movement of the shroud 134 in the transverse direction relative to the body 130. In FIG. 7, the side elements are identified as 184*a* and 184*b* for clarity of illustration. The side elements are positioned so that, when the shroud 134 abuts one of the elements 184, the shroud is in the open or closed positions. For instance, in FIG. 6, the shroud 134 abuts the element identified as 184*b* in FIG. 7. This locates the shroud 134 in the open position. In FIG. 7, the shroud 134 abuts the element 184*a*. The shroud 134 is located in the closed position by the element 184*a*.

As can be seen in FIG. 8, the charge 164 preferably is positioned in the mill shell chamber 122 in the mill shell 124, and the charge 164 has a depth "$D_1$". The charge 164 is introduced into the mill shell chamber 122 at an intake end 166 of the mill shell 124, as indicated by arrow "$C_1$". As is known, the depth "$D_1$" of the charge 164 preferably is such that the top surface "$T_1$" of the charge 164 is below the axis of rotation 148.

For clarity of illustration, the discharge grate assemblies shown in FIGS. 8 and 9 are identified as 120*a* and 120*b*. Also for the purposes of illustration, the discharge grate assemblies 120*a* and 120*b* are shown in FIGS. 8 and 9 in the 6 o'clock and 12 o'clock positions respectively. Those skilled in the art would appreciate that there are a number of other discharge grate assemblies positioned between the discharge grate assemblies 120*a*, 120*b*, and such other discharge grate assemblies are omitted from FIGS. 8 and 9 for clarity of illustration. As the mill shell 124 rotates about the axis 148 in the predetermined direction, the discharge grate assemblies 120 are also moved around the axis of rotation in turn. Each of the discharge grate assemblies 120 is respectively rotatable between a lowered condition, in which the slurry is potentially flowable through at least part of the discharge grate assembly, and a raised condition, in which the discharge grate assembly is located above the charge.

For convenience, in FIG. 9, the pulp lifter chambers are shown in the 6 o'clock and 12 o'clock positions and are identified as 128*a* and 128*b* respectively. As indicated by arrows "$E_1$" and "$F_1$" in FIGS. 8 and 9, because the shroud 134 of the discharge grate assembly 120*a* is in the open position, the slurry moves through the apertures 132 and the openings 138 of the discharge grate assembly 120*a* into the pulp lifter chamber 128*a*. Similarly, in the discharge grate assembly 120*b* positioned at the 12 o'clock position, the shroud 134 is in the closed position. Accordingly, the slurry exits the pulp lifter chamber 128*b* toward a discharge trunnion 126, as schematically indicated by arrows "$G_1$" and "$H_1$" in FIGS. 8 and 9. As can be seen in FIGS. 8 and 9, because the discharge grate assembly 120*b* is closed, backflow is substantially prevented thereby.

Those skilled in the art would be aware that the shroud 134 preferably is in the open position when the discharge grate assembly 120 is in the lowered condition. Also, the shroud 134 preferably is in the closed position when the discharge grate assembly 120 is in the raised condition.

As described above, the invention can be implemented by the addition of the shroud of the invention, appropriate modification of a pre-existing discharge grate body, and, preferably, the addition of the motion subassembly of the invention. It will be understood that the invention herein includes the elements used to implement the invention by retrofitting the pre-existing discharge grate body.

It will be appreciated by those skilled in the art that the invention can take many forms, and that such forms are within the scope of the invention as described above. The foregoing descriptions are exemplary, and their scope should not be limited to the preferred versions provided therein.

We claim:

1. A grinding mill comprising a shell defining a mill shell chamber therein rotatable in a predetermined direction about a central axis thereof to produce a slurry including liquid and particles from a charge located in the mill shell chamber, the grinding mill comprising:

a discharge end wall attached to the shell, the discharge end wall extending between an outer edge thereof connected to the shell and an inner edge at least partially defining a central opening in the discharge end wall;

a plurality of pulp lifter chambers at least partially defined by the discharge end wall; and a plurality of discharge grate assemblies, each said discharge grate assembly being positioned to at least partially control flow of slurry into each said pulp lifter chamber respectively;

each said discharge grate assembly being rotatable in the predetermined direction between a lowered condition, in which the slurry is flowable through at least part of the discharge grate assembly, and a raised condition, in which the discharge grate assembly is positioned above the charge;

each said discharge grate assembly comprising:

a body comprising a plurality of apertures for permitting the slurry to flow from the mill shell chamber into the pulp lifter chamber therefor; and a shroud comprising a plurality of cover elements and a plurality of openings between the cover elements, the shroud being movable relative to the body between an open position, in which the openings are at least partially aligned with at least preselected ones of the apertures to permit the slurry to flow therethrough into at least one pulp lifter chamber, and a closed position, in which the cover elements are at least partially aligned with at least predetermined ones of the apertures, to at least partially prevent the slurry flowing through the apertures.

2. A grinding mill according to claim 1 additionally comprising at least one motion subassembly, for moving the shroud between the closed and open positions.

3. A grinding mill according to claim 1 in which the movement of the shroud between the closed and open positions as the mill shell rotates is at least partially due to gravity.

4. A grinding mill according to claim 1 in which the movement of the shroud between the open and closed positions is substantially in radial directions relative to the central axis.

5. A grinding mill according to claim 1 in which the movement of the shroud between the open and closed positions is substantially orthogonal to a radial direction relative to the central axis.

* * * * *